United States Patent [19]

Schadow

[11] 4,152,556

[45] May 1, 1979

[54] NOISE SUPPRESSION PUSHBUTTON INTERLOCKED SWITCH ASSEMBLY

[75] Inventor: Rudolf Schadow, Berlin, Fed. Rep. of Germany

[73] Assignee: ITT Industries, Inc., New York, N.Y.

[21] Appl. No.: 823,846

[22] Filed: Aug. 11, 1977

[30] Foreign Application Priority Data

Aug. 28, 1976 [DE] Fed. Rep. of Germany ..... 2639941

[51] Int. Cl.[2] ..... H01H 9/26; H01H 1/14

[52] U.S. Cl. ..... 200/5 B; 200/5 E; 200/238; 200/275; 200/283

[58] Field of Search ..... 74/483 PB; 200/5 R, 200/5 B, 5 E, 5 EA, 5 EB, 153 J, 159 A, 275, 283, 237, 238

[56] References Cited

U.S. PATENT DOCUMENTS

| | | | |
|---|---|---|---|
| 3,646,283 | 2/1972 | Hansen | 200/153 J X |
| 3,739,110 | 6/1973 | Constable | 200/5 R |
| 3,882,056 | 5/1975 | Nakasone | 200/1 R X |
| 4,010,382 | 3/1977 | Nishioka et al. | 200/5 R X |
| 4,095,059 | 6/1978 | Nishioka et al. | 200/5 B |

*Primary Examiner*—James R. Scott

*Attorney, Agent, or Firm*—James B. Raden; William J. Michals

[57] ABSTRACT

The noise suppression contact of a keyboard with a row of pushbutton-operated slide switches consists of a flat U-shaped contact spring forming a double armed lever one arm of which is actuated by the stop slider and the other contacting a fixed contact. The pushbutton operators are mutually interlocked by the stop slides. The noise suppression contact assembly is activated momentarily during the change over from one desired switching mode of operation to another switching mode of operation thereby preventing disturbing "clicks" caused by the shorting of an amplifier input.

9 Claims, 6 Drawing Figures

NOISE SUPPRESSION PUSHBUTTON INTERLOCKED SWITCH ASSEMBLY

BACKGROUND OF THE INVENTION

The present invention relates to a keyboard comprising pushbutton-actuated slide switches arranged side by side in a common hold bar, in which a stop slider capable of moving transversely in relation to the actuating direction is disposed and serves the mutual latching and/or tripping of the pushbutton-actuated slide switches, and comprising at least one switch capable of being actuated by the stop slider.

This additional switch is aimed at preventing disturbing clicks caused by the shorting of an amplifier input upon each actuation of a pushbutton-actuated slide switch. Therefore, such switches are referred to as "noise suppression switches" and, as a rule, individually coupled to each pushbutton key. It is also possible, however, to provide one such noise suppression switch in common for several pushbutton-actuated slide switches of a pushbutton assembly and, for this purpose, to use the stop slider as respectively actuated by all pushbutton-actuated slide switches, for effecting the tripping.

It is the object of the invention to insert an additional switch into a pushbutton assembly without involving any considerable investment. This additional switch is to be arranged in the portion of the pushbutton assembly not facing the actuating side, and supposed to consist of a small number of parts which are easy to assemble. Each pushbutton assembly shall be of simple design and capable of being equipped with such an additional switch capable of being actuated by the stop slider, without requiring any further auxiliary means.

SUMMARY OF THE INVENTION

In a pushbutton assembly of the type mentioned hereinbefore, this object is achieved in that the switch consists of a contact which is stationary with respect to the holding arrangement and of a contact spring capable of tilting about a centre of rotation which is fixed with respect to the holding arrangement, with said contact spring being in active connection, at one end, with the stop slider and, at the other end, with the stationary contact.

In an advantageous manner, the invention may be designed in that the contact spring of the additional switch is moulded to or connected in one piece with a terminal stationarily arranged in a mounting board.

Preferably, also differently long lever arms of the contact spring may be caused to actuate the contact and to come into engagement with the stop slider, in that the terminal of the contact spring is provided with a lever edge by which the centre of rotation of the spring becomes adjustable.

One further advantageous embodiment of the invention is featured by the fact that the stationary terminals and the contact spring of the switch are made from one piece of spring material, capable of being folded and inserted into a mounting board, by being provided with at least one preset breaking point which is broken for the purpose of putting the switch into operation. Further required preset breaking points may be provided, by the breaking of which additional spring arms and additional contacts may be put into operation.

Moreover, the invention may still be further developed in that the free end of one U-leg of the contact spring is fanned out to form several additional spring arms capable of being connected to the stationary contacts in the mounting board independently of one another.

The pushbutton assembly together with its advantageous further embodiments, will now be described with reference to examples shown in FIGS. 1 to 6 of the accompanying drawings, in which:

DETAILED DESCRIPTION

Figure 2:
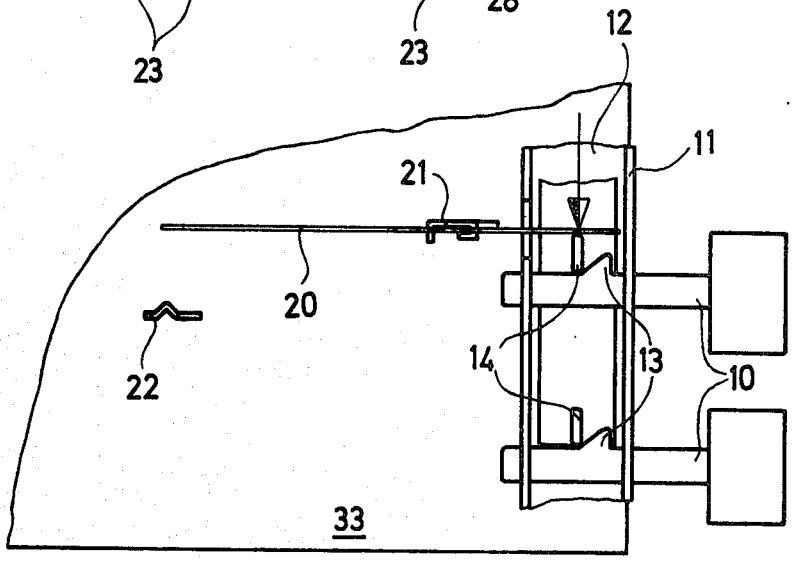
FIGS. 1 and 2 show an additional switch on a pushbutton assembly in a top view, as mounted to a mounting board.
Figure 1:
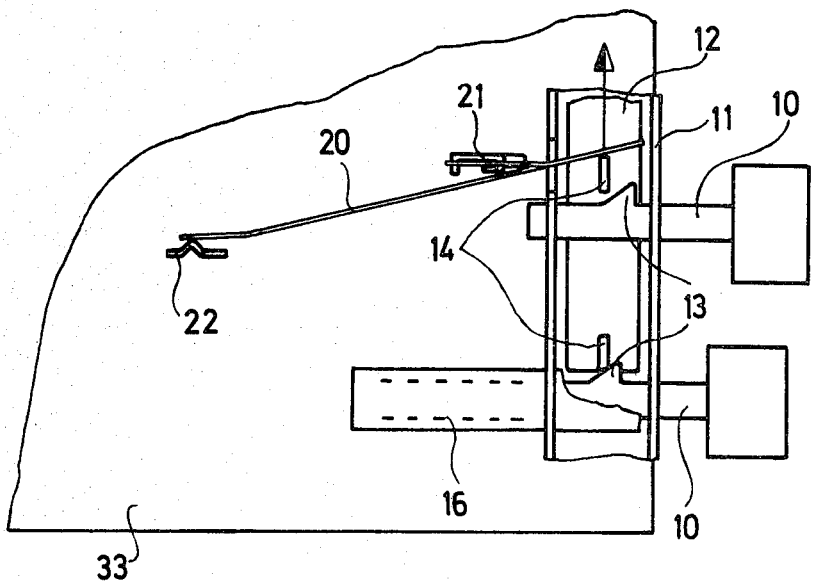

The pushbutton assembly as shown in FIGS. 1 and 2, consists of two pushbutton-operated slide switches of which the one (16) is shown partly broken away for the sake of recognizing the common holding and latching. Of the other pushbutton-operated slide switch there is only shown the pushbutton slide so as to enable a better recognition of the substantial parts. Both pushbutton-operated slide switches are guided with their pushbutton slides 10 in one common hold rail 11. A stop slider 12 is arranged within the hold rail 11 capable of moving transversely in relation to the direction of actuating the pushbutton slides. The stop slider 12 is actuated by slanting run-up surfaces 13 provided for on the pushbutton slides, via projections 14 arranged on the stop slider.

The additional switch has two terminals 21, 22 which can be electrically connected by a contact spring 20. This contact spring 20 is in such a way arranged between a fixed contact 22 and the actuating member of the stop slider 14 that it, in response to a lateral movement of the stop slider 12, will perform a rotation about the terminal 21 thus coming to lie against the fixed contact 22. The contact spring may be pretensioned and applied to the stop slider 12, thus simultaneously also performing the function of a stop slider/reset spring.

While the additional switch is shown to be switched on in FIG. 1, it is shown in its switch-off position caused by the lateral movement of the stop slider 12, in FIG. 2. Now, the nature of the invention is to be seen in that any arbitrary pushbutton assembly is easy to equip with a few parts (20, 21, 22) on a mounting board 33 which, for example, may be a printed circuit board. The few parts are also still additionally attachable to already existing pushbutton assemblies.

Figure 3:
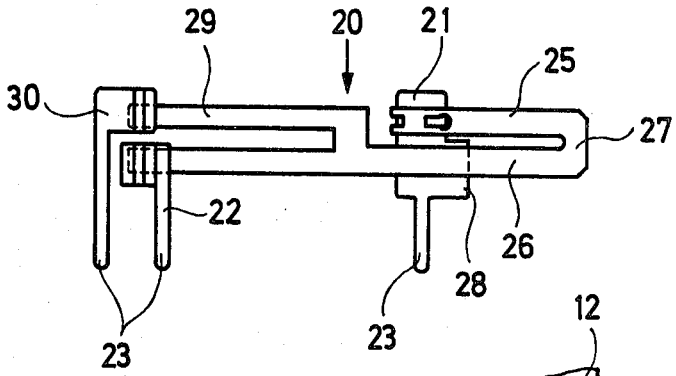
FIG. 3 shows an additional switch in a side view.

As may be taken from a side view of the additional switch (without the parts of the pushbutton assembly) shown in FIG. 3, it is possible to use and to assemble simple stamped metal parts. The terminals 21, 22 may be provided with plug-in pins 23 by which they may be plugged to a mounting board 33. These pins, together with the terminals of the individual pushbutton-operated slide switches, will then project on one side.

In FIG. 3 there is shown to be used a U-shaped contact spring 20 which is mounted with its one leg 25 to the terminal 21, while the other U-leg 26 is arranged in front of the fixed contact 22. The contact spring 20 is actuated by the stop slider 12 engaging at the U-bend 27, thus levering about the edge 28 of the stationary terminal 21 so that firm contact spacings can be adjusted in relation to the stop slider movement. By bending the edge 28 it is possible to adjust differently long levers and lever paths by which the switch, for example, can be adjusted with respect to inaccuracies of the plug-in points of the terminals.

The free U-leg 26 of the contact spring 20 is produced in such a way in a fan-like manner comprising several arms 29, that several fixed contacts 22, 30 can be actuated independently of one another.

Figure 4:
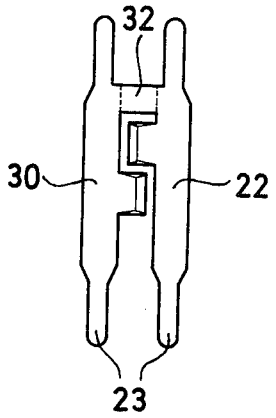
FIG. 4 shows a special type of fixed contact provided with a preset breaking point for use if so required.

FIG. 4 shows a fixed contact 22 suitable for twin use, whose breaking point 32 provided for being used if so required, is broken for obtaining in this way two electrically independent fixed contacts.

The additional switch requires no further housing because of being inserted into the mounting board together with the push-button assembly. Accordingly, it only consists of metal parts.

Figure 5:
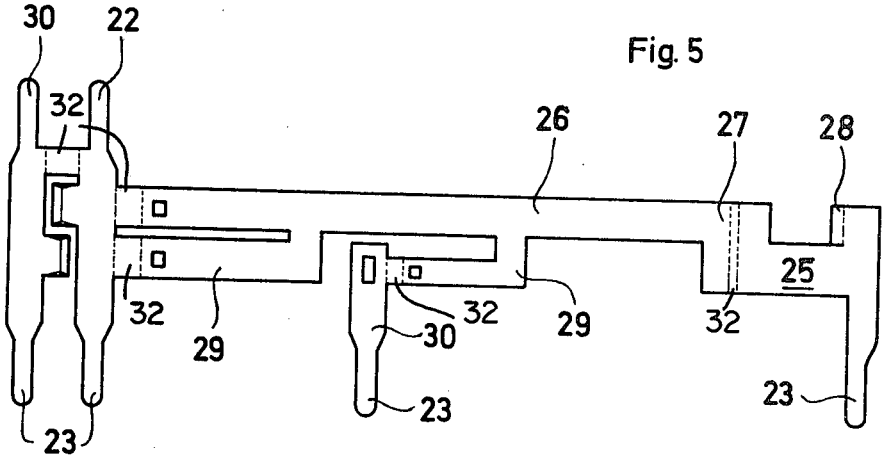
FIGS. 5 and 6 show a foldable additional switch made in one piece, for use with a pushbutton assembly.
Figure 6:
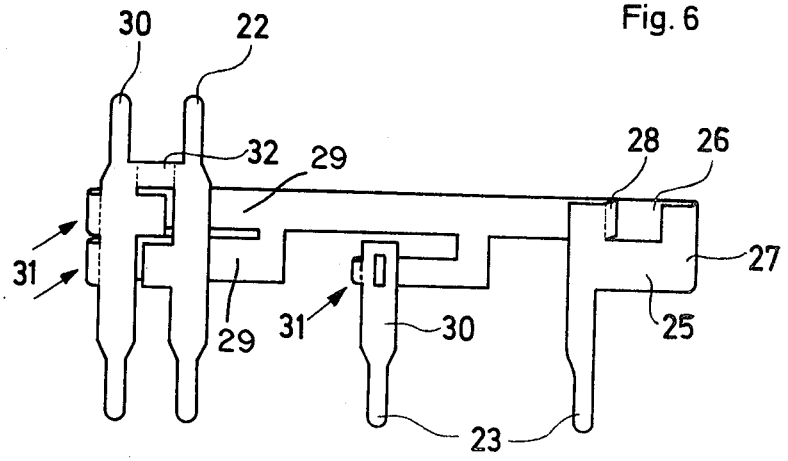

Advantageously, the additional switch may also be made in one piece, as is shown in FIGS. 5 and 6. A piece of sheet metal made from spring material, provided with extensions for the fixed contacts 22, 23, after having been folded and assembled into the pushbutton assembly, may be taken apart in such a way at the preset breaking points 31, that a finished switch is obtained. Since any suitable pushbutton assemblies may be provided with such switches, the invention is already seen to reside in providing this simple switch consisting of sheet metal strips, whose shape and breaking points are arranged in such a way as to permit a later insertion into a pushbutton assembly in the proper way.

Also other versions of an additional switch are conceivable according to the invention, suitable for being plugged into the holding arrangement of a pushbutton assembly. The additional switches should employ contact springs levering on both sides, thus extending into the interior of the pushbutton assembly. They may engage the stop slider at any suitable point but, in a compact pushbutton assembly, are preferably arranged on one of the two outer sides.

What is claimed is:

1. A keyboard switch for use with a keyboard comprising pushbutton-actuated slide switches arranged side by side in a common hold bar, in which a stop slide capable of moving transversely in relation to the actuating direction is disposed and serves the mutual latching and/or tripping of the pushbutton-actuated slide switches, and comprising a switch capable of being actuated by the pushbutton-operated slide switches in common by way of the stop slide, wherein the switch consists of a first contact terminal which is stationary with respect to the holding arrangement and of a contact spring capable of tilting about a center of rotation which is fixed with respect to the holding arrangement, with said contact spring being engageable at one end thereof, with the stop slide and, at the other end thereof, with the stationary contact and being connected to a second stationary contact terminal, and wherein the contact spring is U-shaped having U-legs of differing lengths, wherein the shorter U-leg is attached to the keyboard at the center of rotation, wherein the longer U-leg forms the moving contact end, and wherein the U-bend forms the actuating end.

2. A keyboard switch for use with a keyboard comprising pushbutton-actuated slide switches arranged side by side in a common hold bar, in which a stop slide capable of moving transversely in relation to the actuating direction is disposed and serves the mutual latching and/or tripping of the pushbutton-actuated slide switches, and comprising a switch capable of being actuated by the pushbutton-operated slide switches in common by way of the stop slide, wherein the switch consists of a first contact terminal which is stationary with respect to the holding arrangement and of a contact spring capable of tilting about a center of rotation which is fixed with respect to the holding arrangement, with said contact spring being engagable at one end thereof, with the stop slide and, at the other end thereof, with the stationary contact and being connected to a second stationary contact terminal, and wherein the contact spring comprises first and second lever arms of differing length respectively for the contact actuation and the engagement with the stop slide.

3. A keyboard switch according to claim 2, wherein the stationary terminals are provided with plug-in pins.

4. A keyboard switch according to claim 3, wherein the terminal of the contact spring is provided with a lever edge by which the center of rotation of the spring is capable of being readjusted.

5. A keyboard switch for use with a keyboard comprising pushbutton-actuated slide switches arranged side by side in a common hold bar, in which a stop slide capable of moving transversely in relation to the actuating direction is disposed and serves the mutual latching and/or tripping of the pushbutton-actuated slide switches, and comprising a switch capable of being actuated by the pushbutton-operated slide switches in common by way of the stop slide, wherein the switch consists of a first contact terminal which is stationary with respect to the holding arrangement and of a contact spring capable of tilting about a center of rotation which is fixed with respect to the holding arrangement, with said contact spring being engagable at one end thereof, with the stop slide and, at the other end thereof, with the stationary contact and being connected to a second stationary contact terminal, and wherein the stationary terminals and the contact spring are made from one-piece of spring material which is suitable folded and provided with preset breaking points which are broken away for installing the keyboard switch into its operational position.

6. A keyboard switch according to claim 5, wherein at least one further breaking point is provided between and additional fixed contact portion and an additional spring arm and wherein additional contacts are provided by breaking of the additional spring arms.

7. A keyboard switch for use with a keyboard comprising pushbutton-actuated slide switches arranged side by side in a common hold bar, in which a stop slide capable of moving transversely in relation to the actuating direction is disposed and serves the mutual latching and/or tripping of the pushbutton-actuated slide switches, and comprising a switch capable of being actuated by the pushbutton-operated slide switches in common by way of the stop slide, wherein the switch consists of a first contact terminal which is stationary with respect to the holding arrangement and of a contact spring capable of tilting about a center of rotation which is fixed with respect to the holding arrangement, with said contact spring being engagable at one end thereof, with the stop slide and, at the other end thereof, with the stationary contact and being connected to a second stationary contact terminal, and wherein the contact spring consists of flat material which is punched out in a U-shaped manner, wherein one U-leg is connected to one stationary contact terminal and the other U-leg freely extends adjacent to the other stationary contact and is capable of being connected thereto when the stop slide laterally engages the U-bend.

8. A keyboard switch according to claim 7, wherein the free end of said other U-leg is fanned out to form several additional spring arms which, independently of one another, are capable of being connected to stationary contacts in the keyboard mounting board.

9. A keyboard switch according to claim 8, wherein the contact spring is pretensioned against said stop slide to provide a reset spring urging said stop slide into its unactivated position.

* * * * *